US007448712B2

(12) United States Patent
Hatasa et al.

(10) Patent No.: US 7,448,712 B2
(45) Date of Patent: Nov. 11, 2008

(54) SIGNALING MODULE, LIQUID CONTAINER, RECORDING APPARATUS, AND CONTROL METHOD

(75) Inventors: Nobuyuki Hatasa, Kawasaki (JP); Kenjiro Watanabe, Ohta-ku (JP); Kimiyuki Hayasaki, Yokohama (JP); Tatsuhiko Yamazaki, Zama (JP); Tetsuya Tateno, Hatano (JP)

(73) Assignee: Canon Kabushiki Kaisha, Tokyo (JP)

( * ) Notice: Subject to any disclaimer, the term of this patent is extended or adjusted under 35 U.S.C. 154(b) by 252 days.

(21) Appl. No.: 11/448,193

(22) Filed: Jun. 7, 2006

(65) Prior Publication Data

US 2006/0290729 A1 Dec. 28, 2006

(30) Foreign Application Priority Data

Jun. 23, 2005 (JP) ..... 2005-183981

(51) Int. Cl.
*B41J 29/38* (2006.01)

(52) U.S. Cl. ..... 347/14; 347/19; 347/7

(58) Field of Classification Search ..... 347/7, 347/14, 19, 64–86
See application file for complete search history.

(56) References Cited

U.S. PATENT DOCUMENTS

| | | | | |
|---|---|---|---|---|
| 6,086,178 | A * | 7/2000 | Kawashima et al. | 347/7 |
| 6,619,776 | B2 * | 9/2003 | Yoshiyama et al. | 347/7 |

FOREIGN PATENT DOCUMENTS

| | | |
|---|---|---|
| EP | 779156 | 6/1997 |
| EP | 1547781 | 6/2005 |
| JP | 4-275156 A | 9/1992 |
| JP | 7-076104 A | 3/1995 |
| JP | 2002-301829 A | 10/2002 |

* cited by examiner

*Primary Examiner*—Thinh H Nguyen
(74) *Attorney, Agent, or Firm*—Canon USA Inc I.P. Div

(57) ABSTRACT

An ink tank receives data signals from a printer and an LED provided on the ink tank is driven on the basis of the received data signals. The LED is driven in an inactive time period that is different from the time period in which the date signals are input to the ink tank.

1 Claim, 14 Drawing Sheets

SIGNALING MODULE, LIQUID CONTAINER, RECORDING APPARATUS, AND CONTROL METHOD

BACKGROUND OF THE INVENTION

1. Field of the Invention

The present invention relates to a liquid-container module, a liquid container, a recording apparatus, and a control method, and more particularly, to a liquid container including a light-emitting unit, such as a light-emitting diode (LED), for optically presenting various information.

2. Description of the Related Art

Recently, as digital cameras have come into widespread use, a recording method called non-PC recording has become popular in which a digital camera is directly connected to a printer that serves as a recording apparatus to perform a recording operation without using a personal computer (PC). In addition, another recording method in which a card-shaped information storing medium for a digital camera is directly attached to a printer for data transmission to perform a printing/recording operation has also become popular.

A method for checking an amount of ink remaining in an ink tank of a printer is discussed in, for example, Japanese Patent Laid-Open No. 7-76104. According to this method, data regarding the amount of remaining ink is stored in a storage element, such as a memory, provided on the ink tank. The printer accesses the storage element to obtain the data regarding the amount of remaining ink and displays the data on a monitor via a PC.

However, also in non-PC recording, there is a demand to check the amount of ink remaining in the ink tank without using a PC. If a user recognizes that there is only a small amount of ink remaining in the ink tank, the user can replace the ink tank with a new ink tank before starting the printing/recording operation, so that failure due to ink shortage can be prevented.

A typical structure for informing the user of the state of the ink tank includes a display element, such as an LED. Japanese Patent Laid-Open No. 4-275156 discloses a structure including two LEDs on an ink tank that is integrated with a recording head. The two LEDs are turned on in two steps in accordance with the amount of remaining ink.

Similarly, Japanese Patent Laid-Open No. 2002-301829 discusses a structure in which a lamp that is turned on in accordance with the amount of remaining ink is provided on an ink tank. This publication also discusses a recording apparatus including four ink tanks, each of which is provided with a lamp discussed in Japanese Patent Laid-Open No. 4-275156.

Japanese Patent Laid-Open No. 7-76104 discusses a timing chart showing timing at which a storage element (ROM) provided on an ink tank is accessed. However, the ink tank is not provided with a light-emitting unit, such as an LED. The other publications discuss structures in which an LED and a storage element, such as electrically erasable programmable read-only memory (EEPROM), are mounted on an ink tank or a cartridge. However, a control method including timing at which the LED is turned on and off is not discussed.

In general, to turn on an LED, a driver for driving the LED performs an operation (ON operation) for applying a power source voltage to the LED while an input signal is ON. To turn off the LED, the driver performs an operation (OFF operation) for switching off the power source voltage applied to the LED. Accordingly, when the ON/OFF operation in which the power source voltage is applied or switched off is performed to turn on or off the LED, a current higher than that applied for driving a control circuit or a memory provided on a semiconductor substrate is applied to a circuit of the LED. Therefore, there is a risk that noise will be generated when the relatively high rush current is applied.

The LED and the EEPROM mounted on the ink tank are controlled via a signal line connecting an electrical contact on the ink tank and an electrical contact on a cartridge in which the ink tank is mounted. For example, the printer transmits an identifier corresponding to the color of ink contained in the ink tank and a signal for controlling the illumination of the LED to the EEPROM mounted on the ink tank, so that the illumination of the LED provided on the ink tank corresponding to the identifier can be controlled.

However, if the noise generated due to the relatively high current applied to the circuit of the LED is input to the signal line for signal transmission, transmission and reception of the identifier and the control signal are disturbed. Accordingly, there is a risk that accurate signals cannot be transmitted to the ink tank. When accurate signals cannot be transmitted, the operation of turning on and off the LED and the operation of writing to and reading from the EEPROM cannot be performed normally. As a result, accurate information and recording result cannot be provided to the user.

SUMMARY OF THE INVENTION

In light of the above-described situation, the present invention is directed to a liquid-container module, a liquid container, a recording apparatus, and a control method in which illumination of a display element, such as an LED, can be controlled without affecting signals with noise.

According to an aspect of the present invention, a signaling module mountable on a liquid container for supplying liquid to a recording/printing apparatus includes a signal-connecting portion capable of receiving an input signal from the recording/printing apparatus; a light-emitting unit capable of emitting light; a light-emission driving unit that drives the light-emitting unit; and a control circuit that controls the driving of the light-emitting unit by the light-emission driving unit on the basis of the input signal transmitted from the signal-connecting portion. The control circuit arranges for the driving of the light-emitting unit by the light-emission driving unit to occur in a period different from the period in which the input signal is transmitted from the signal-connecting portion.

The signaling module may further include an information storage portion that stores information regarding the liquid container, and the control circuit may perform at least one of a driving process or an information process on the basis of the input signal transmitted from the signal-connecting portion, the control circuit controlling the driving of the light-emitting unit by the light-emission driving unit in the driving process and controlling at least one of an operation of writing information to the information storage portion and an operation of reading information from the information storage portion in the information process.

In the signaling module, the control circuit may perform a process of outputting a response signal from the signal-connecting portion in response to the input signal and performs the driving process in a period different from either of periods in which the input signal and the response signal are transmitted from the signal-connecting portion.

In addition, in the signaling module, the control circuit may perform the driving process in a signal input/output inactive period provided between periods in which signals are input and output from the signal-connecting portion.

In the signaling module, the input signal may include individual information and a control code and the information storage portion stores individual information of the liquid container on which the signaling module is mounted. When the individual information included in the input signal corresponds to the individual information stored in the information storage portion, the control circuit performs at least one of the driving process and the information process on the basis of the control code included in the input signal together with the individual information.

In the signaling module, the input signal may include a communication start code. In addition, the signal-connecting portion may include a clock input section to which a clock signal is input from the recording apparatus, and the control circuit may control the driving of the light-emitting unit by the light-emission driving unit in a period that starts when the communication start code is input and that is set on the basis of the clock signal.

According to another aspect of the present invention, a liquid container that supplies liquid to a recording apparatus includes a signal-connecting portion capable of receiving an input signal from the recording apparatus; a light-emitting unit capable of emitting light; a light-emission driving unit that drives the light-emitting unit; and a control circuit that controls the driving of the light-emitting unit by the light-emission driving unit on the basis of the input signal transmitted from the signal-connecting portion. The control circuit controls the driving of the light-emitting unit by the light-emission driving unit in a period different from a period in which the input signal is transmitted from the signal-connecting portion.

In the liquid container, the liquid reservoir and signaling module may form a single unit.

According to another aspect of the present invention, a recording apparatus that records an image using liquid supplied from the liquid container that can be mounted on the recording apparatus includes a recording-apparatus signal-connecting portion capable of supplying the input signal to the signal-connecting portion included in the liquid container.

In addition, the recording apparatus may further include a control circuit that generates the input signal.

The recording apparatus may be capable of holding a plurality of the liquid containers and the recording-apparatus signal-connecting portion may be connected to the first signal-connecting portion of each of the liquid containers.

According to another aspect of the present invention, a method for controlling a light-emitting signaling module included in or on a liquid container for supplying liquid to a recording apparatus includes controlling driving of the light-emitting unit by a light-emission driving unit on the basis of a signal input to the liquid container from the recording apparatus. The step of controlling the driving of the light-emitting unit by the light-emission driving unit is performed in a period different from a period in which the signal is input to the liquid container from the recording apparatus.

Further features of the present invention will become apparent from the following description of exemplary embodiments with reference to the attached drawings.

DESCRIPTION OF THE EMBODIMENTS

Embodiments of the present invention will be described below with reference to the accompanying drawings.

Figure 10:
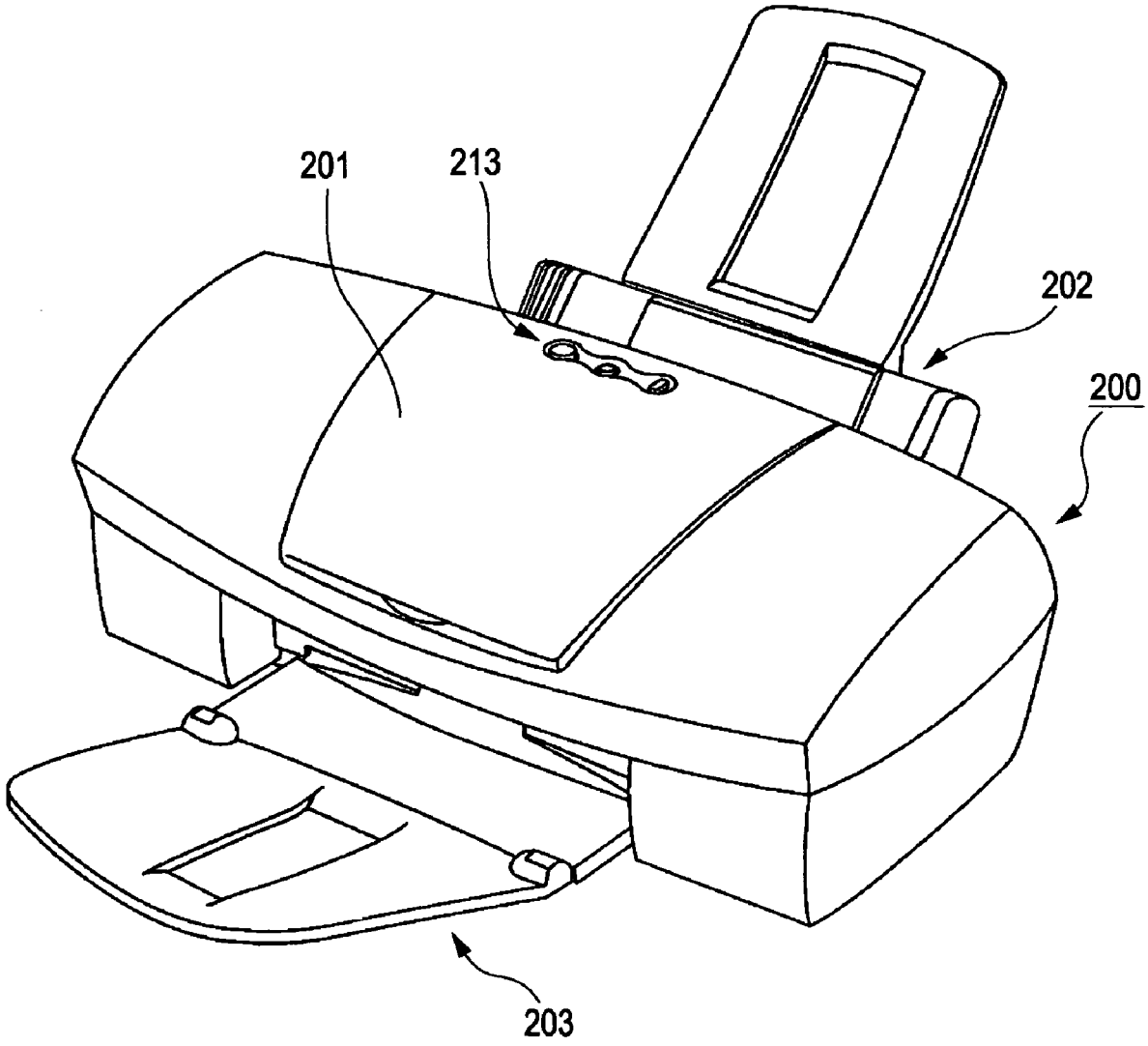
FIG. 10 illustrates a perspective view of an inkjet printer to which the present invention can be applied.
Figure 11:
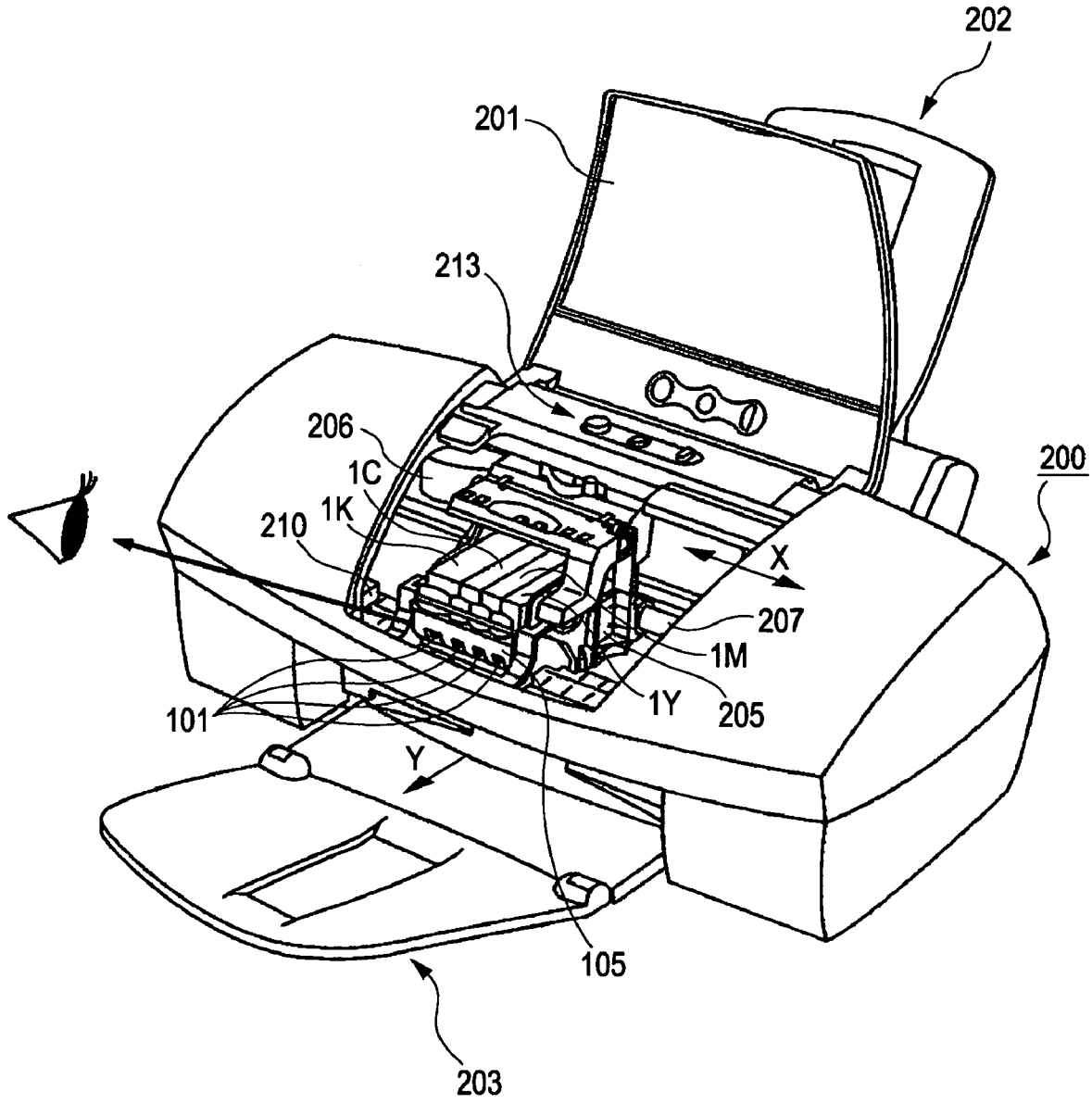
FIG. 11 illustrates a perspective view of the inkjet printer shown in FIG. 10 in a state in which a main cover of the inkjet printer is opened.

Structure of Recording Apparatus (FIGS. 10 and 11)

FIG. 10 illustrates a perspective view of an inkjet printer (inkjet recording apparatus) 200 to which ink tanks that will be described below can be attached to perform a recording operation. FIG. 11 illustrates a perspective view of the inkjet printer 200 shown in FIG. 10 in a state in which a main cover 201 is opened.

As shown in FIG. 10, the printer 200 according to the present embodiment includes a printer main body, a paper output tray 203 disposed at the front side of the printer main body, and an automatic sheet feeder (ASF) 202 disposed at the back side of the printer main body. In the printer main body, a main part of the printer is covered with a main-body cover 201 and other casing members. The main part includes a mechanism for moving a carriage on which a recording head and ink tanks are mounted in the recording operation. The printer main body also includes an operating unit 213 that can be operated irrespective of whether the main-body cover 201 is open or closed. The operating unit 213 includes a display for displaying the state of the printer 200, a power switch, and a reset switch.

FIG. 11 shows the state in which the main cover 201 is removed. In this state, the user can see the movable range of a carriage 205 that carries a recording head 105 and ink tanks 1K (Bk), 1Y, 1M and 1C and a region around the movable range. In the following description, the ink tanks may simply be denoted by 1 for simplicity.

The ink tanks 1K (Bk), 1Y, 1M, and 1C contain black K (Bk) ink, yellow (Y) ink, magenta (M) ink, and cyan (C) ink, respectively. When the main-body cover 201 is opened, a sequence for automatically moving the carriage 205 to a substantially central position (hereafter also called an ink-tank replacing position), as shown in the figure, is executed. The user can replace each ink tank 1 with a new ink tank when the carriage 205 is at the ink-tank replacing position.

The recording head 105 includes chip-type recording head sections (not shown) corresponding to respective colors of ink.

The recording head 105 performs the operation of recording on a recording medium by discharging ink from nozzles formed in the recording head sections while moving together with the carriage 205 in the main-scanning direction shown by the arrow X. Accordingly, the carriage 205 is slidably guided by a guiding shaft 207 that extends in the main-scanning direction and is reciprocated in the main scanning direction by a carriage motor and transmission mechanism. The recording head sections discharge ink on the basis of discharge data transmitted from a control circuit disposed in the printer main body via a flexible cable 206. The recording medium.(not shown) fed by the automatic sheet feeder 202 is conveyed to the paper output tray 203 by a paper conveying mechanism including conveying rollers and paper-output rollers.

Figure 14:
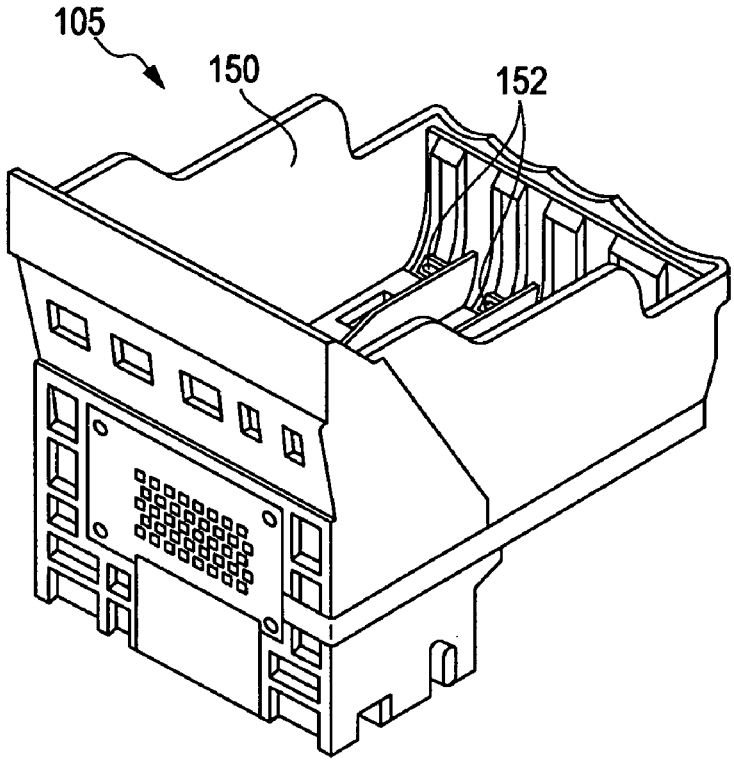
FIG. 14 illustrates a perspective view of a recording head to which the liquid container according to the embodiment of the present invention can be releasably secured.
Figure 15:
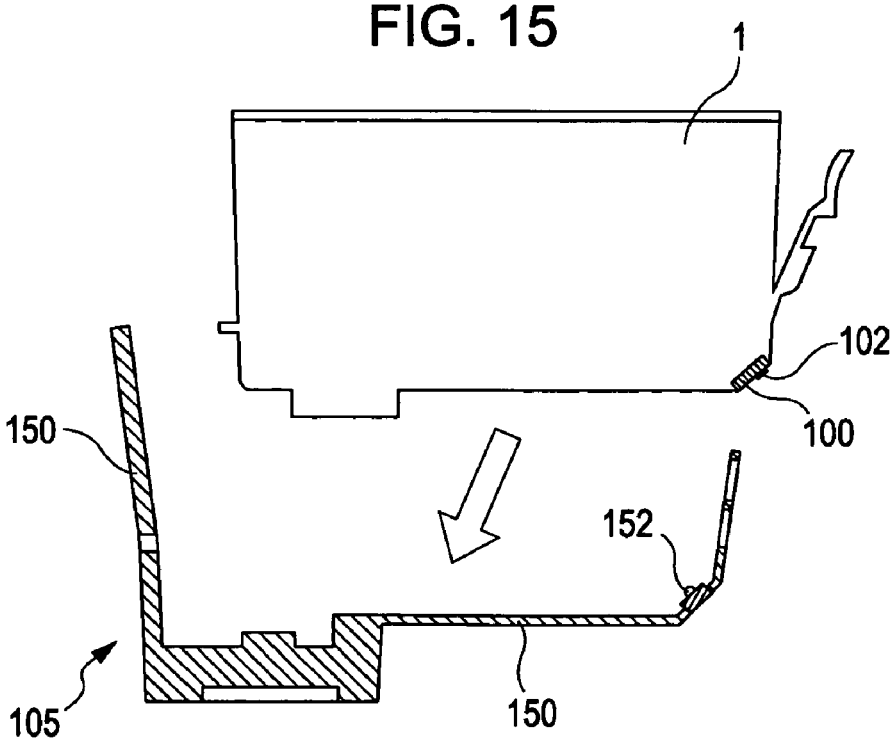
FIG. 15 is a schematic sectional view illustrating the manner in which the liquid container according to the embodiment of the present invention is attached to the recording head.

The recording head 105 includes ink tank holders, as shown in FIG. 14, and is detachably attached to the carriage 205. As shown in FIG. 15, each ink tank 1 is detachably attached to the corresponding ink tank holder of the recording head 105 from the direction shown by the arrow.

In the recording operation, the recording head 105 discharges ink from ejection holes that define the nozzles while moving in the main scanning direction, thereby recording an image on the recording medium within a region corresponding to the width of nozzle lines. Then, before main scanning of the next cycle is started, the paper conveying mechanism conveys the recording medium in a sub-scanning direction shown by the arrow Y (direction that intersects the main-scanning direction) by a predetermined distance. The process of scanning the recording medium and the process of conveying the recording medium are repeated to successively record images on the recording medium. A recovery unit including a cap that covers a surface in which the nozzles are formed in each recording head section is provided at an end of the movable area of the recording head 105 that moves together with the carriage 205. The recording head 105 is moved to the position where the recovery unit is provided at every predetermined time interval, and a recovery process, e.g., a process of causing each recording head section to discharge ink that does not contribute to image recording (preliminary discharge), is performed to maintain the state of ink discharge in a desirable state.

The recording head 105 includes the tank holders for holding the ink tanks 1 (1K, 1Y, 1M, and 1C) and connectors 152 (see FIGS. 13 and 14) corresponding to the ink tanks 1. Each of the contactors 152 comes into contact with a pad (contact) 102 on a substrate provided on the corresponding ink tank 1 when the ink tank 1 is attached to the corresponding tank holder. Each ink tank 1 has an LED 101 that can be turned on/off or caused to blink in accordance with a sequence which will be described below.

More particularly, in the state in which the carriage 205 is at the ink-tank replacing position as shown in FIG. 11, the LEDs 101 on the ink tanks 1 are turned on or caused to blink at least when the amounts of ink remaining in the corresponding ink tanks 1 become small. In addition, a first light-receiving unit 210 (see FIG. 12) including a light-receiving element is provided at an end of the movable range of the carriage 205 opposite to the end at which the recovery unit is provided. When the carriage 205 is moved and the LEDs 101 on the ink tanks 1 pass by the light-receiving unit 210, the LEDs 101 are successively caused to emit light. Light emitted by the LEDs 101 is received by the first light-receiving unit 210, so that positions where the ink tanks 1 are mounted on the carriage 205 can be detected on the basis of the movement positions of the carriage 205 at the time when the light is received. The LEDs 101 may also be turned on when, for example, the ink tanks 1 are properly attached while the carriage 205 is at the ink-tank replacing position. Similar to the ink discharge control of the recording head 105, the LEDs 101 can be controlled by transmitting control data (control signals) to the ink tanks 1 from the control circuit in the printer main body via the flexible cable 206.

Figure 12:
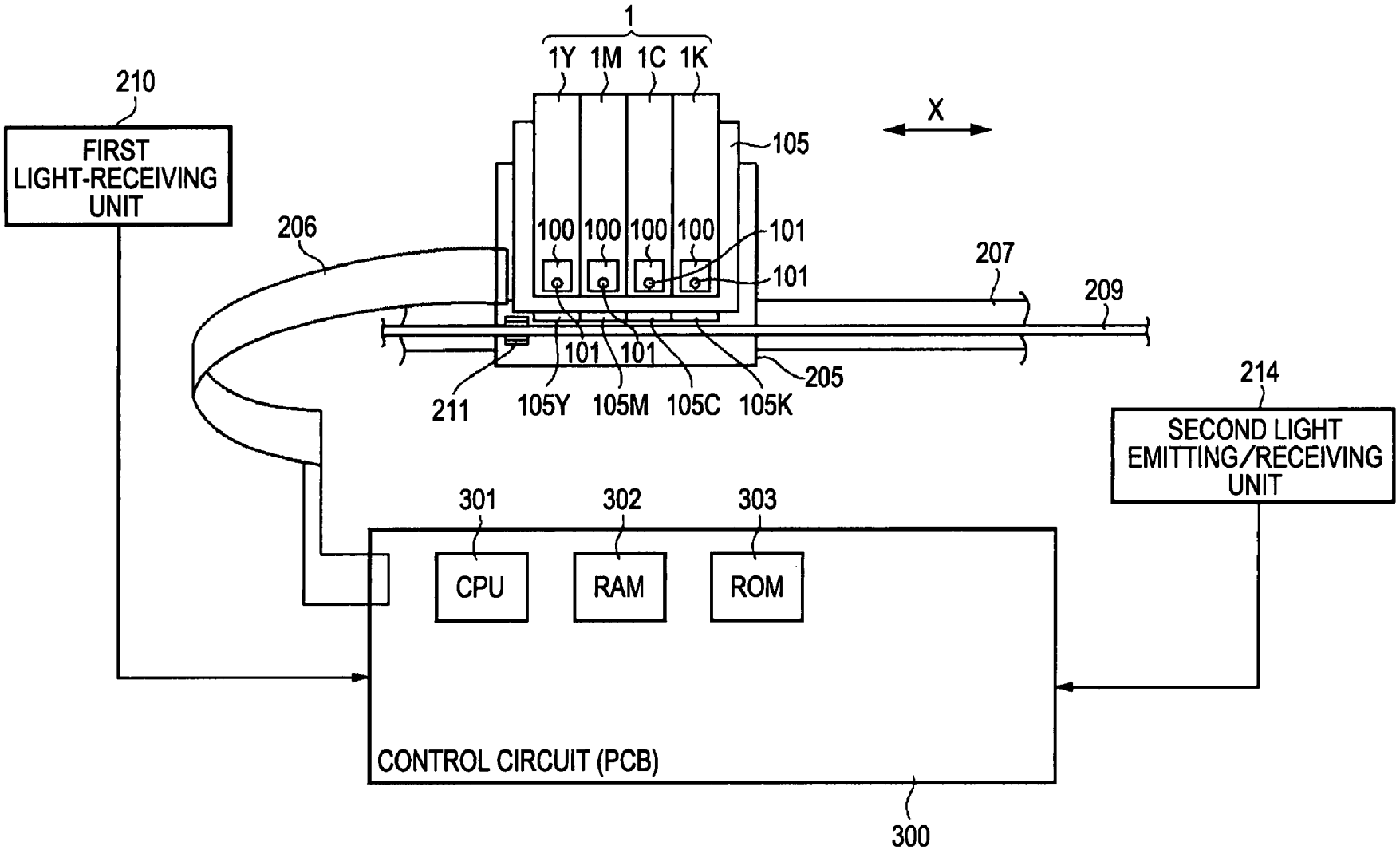
FIG. 12 is a schematic block diagram of a control system of the inkjet printer shown in FIG. 10.

Control Structure (see FIG. 12)

FIG. 12 is a block diagram illustrating the schematic structure of a control system of the above-described inkjet printer. Referring to FIG. 12, the structure includes a control circuit 300 provided in the form of a printed circuit board (PCB) disposed in the printer main body and the LEDs 101 provided on the ink tanks 1 and controlled by the control circuit 300.

The control circuit 300 performs data processing and operation control of the printer. More specifically, a CPU 301 executes processes shown in FIGS. 6 to 9, which will be described below, in accordance with programs stored in a ROM 303. A RAM 302 serves as a work area when the CPU 301 executes the above-mentioned processes.

As schematically shown in FIG. 12, the recording head 105 mounted on the carriage 205 includes head sections 105K, 105Y, 105M, and 105C for discharging black (K) ink, yellow (Y) ink, magenta (M) ink, and cyan (C) ink, respectively. In each recording head section, a plurality of nozzles through which ink is discharged are arranged in lines. The ink tanks 1 (1K, 1Y, 1M, and 1C) corresponding to the recording head sections are releasably secured to the respective tank holders in the recording head 105.

A substrate (module) 100 is attached to each ink tank 1. As described above, the substrate 100 has the LED 101, a display control circuit thereof, and the pad that functions as a contact terminal provided thereon. In addition, the connectors corresponding to the tanks 1 are provided on the tank holders included in the recording head 105. When the ink tanks 1 are properly attached to the recording head 105, the pads (contact terminals) 102 on the substrates 100 of the ink tanks 1 come into contact with the respective connectors 152 provided in the recording head 105 (see FIG. 13). Connectors on the carriage 205 are connected to a connector 110 (see FIG. 1) provided on the control circuit 300 disposed in the printer main body by the flexible cable 206 such that signals can be transmitted. In addition, when the recording head 105 is attached to the carriage 205, the connectors on the carriage 205 are connected to the connectors 152 on the recording head 105. According to such a connection structure, signals can be communicated between the control circuit 300 in the printer main body and the ink tanks 1. As a result, the control circuit 300 can turn on/off the LEDs 101 on the ink tanks 1 or cause the LEDs 101 to blink in accordance with the sequence shown in FIGS. 6 to 8 which will be described below.

The operation of discharging ink from the head sections 105K, 105Y, 105M, and 105C in the recording head 105 is also controlled via the flexible cable 206, the connectors on the carriage 205, and the connectors on the recording head 105. More specifically, drive circuits of the recording head sections are connected to the control circuit 300 disposed in the printer main body so that the control circuit 300 can control the discharge of ink from each of the recording head sections.

The first light-receiving unit 210 positioned near one end of the movable range of the carriage 205 receives light emitted from the LEDs 101 on the ink tanks 1 and outputs corresponding signals to the control circuit 300. The control circuit 300 determines the positions of the ink tanks 1 on the carriage 205 in accordance with the received signals. An encoder scale 209 that extends along the moving path of the carriage 205 is provided in the printer main body, and an encoder sensor 211 is provided on the carriage 205. The control circuit 300 receives a detection signal obtained by the encoder sensor 211 via the flexible cable 206 and determines the movement position of the carriage 205. The position information of the carriage 205 is used for ink discharge control of each recording head section and is also used in a certification process described below in which the position of each ink tank is detected.

A second light-emitting/receiving unit 214 including a light-emitting element and a light-receiving element is disposed at a predetermined position within the movable range of the carriage 205. Signals corresponding to information regarding the amounts of ink remaining in the ink tanks 1 mounted on the carriage 205 are output to the control circuit 300, and the control circuit 300 determines the amounts of ink remaining in the ink tanks 1 on the basis of the received signals.

Figure 13:
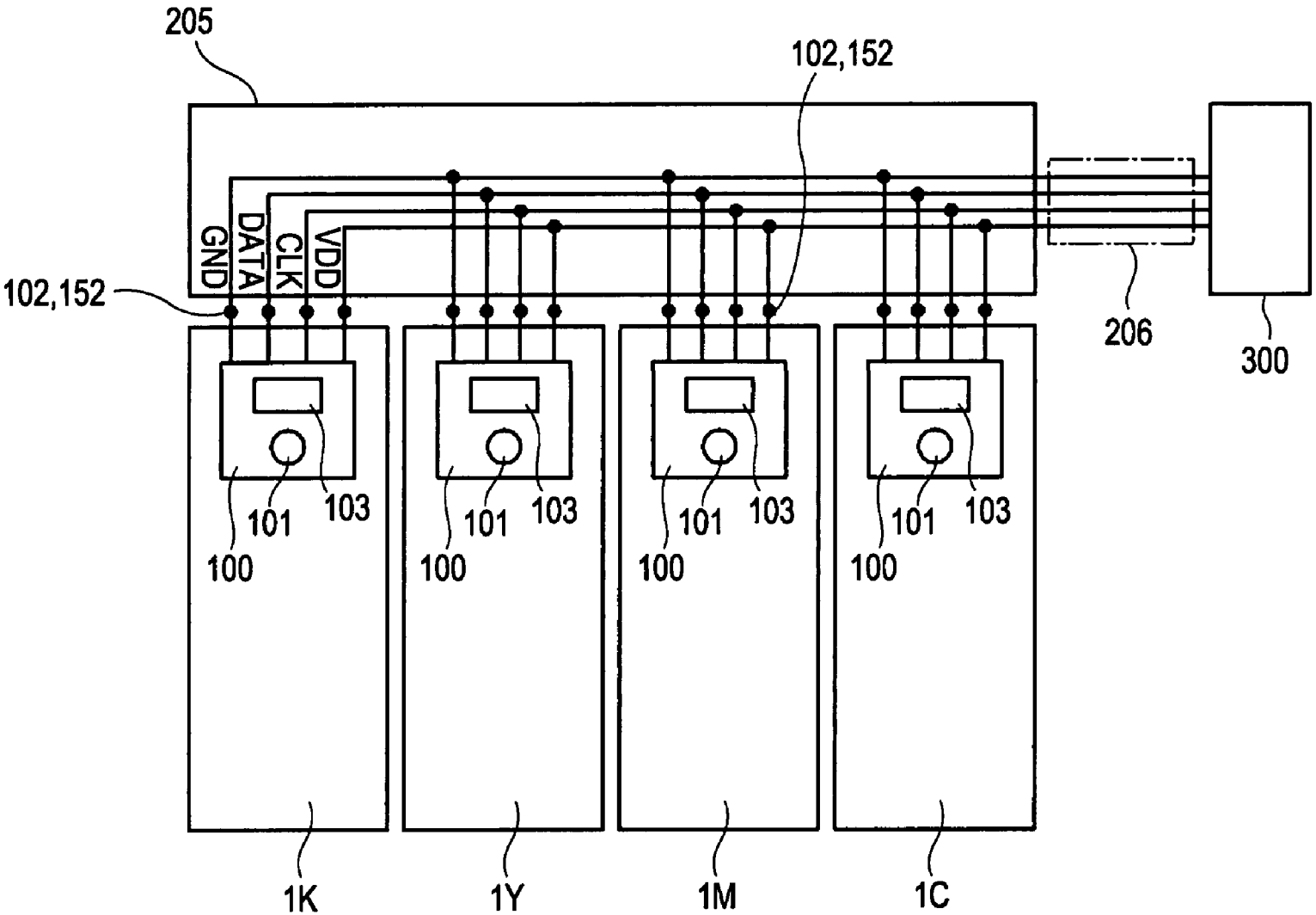
FIG. 13 is a diagram illustrating signal lines between the inkjet printer shown in FIG. 10 and ink tanks.

Structure of Connecting Section (FIG. 13)

FIG. 13 is a diagram illustrating signal lines between the control circuit 300 and the substrates 100 on the ink tanks 1.

As shown in FIG. 13, signal lines connected to the ink tank 1 include four signal lines that are common to all of the four ink tanks 1. The four signal lines connected to the ink tanks 1 include a source signal line 'VDD', a ground signal line 'GND', a signal line 'DATA', and a clock signal line 'CLK'. The source signal line 'VDD' and the ground signal line 'GND' are used for supplying electric power to control elements (control units) 103 that control the illumination of the LEDs 101 on the ink tanks 1. The signal line 'DATA' transmits control signals (control data) supplied from the control circuit 300 for turning on/off the LEDs 101 or causing the LEDs 101 to blink. The clock signal line 'CLK' transmits a clock signal.

The control units 103 operated in response to the signals transmitted via the four signal lines and the LEDs 101 controlled by the control units 103 are provided on the substrates (modules) 100 of the ink tanks 1 (1K, 1Y, 1M, and 1C). The above-described signal-line structure is one of the structures that can minimize the number of connection terminals provided on the ink tanks 1. Due to the above-described signal-line structure, information-presenting means including the LEDs 101 can be controlled and information including the amounts of ink remaining in the ink tanks 1 can be obtained or updated, as described below with reference to timing charts. In FIG. 13, the contact terminals 102 are provided in the form of pads on the ink tanks 1 and the contacts 152 are provided on the tank holders in the recording head to which the ink tanks 1 are mounted.

Figure 1:
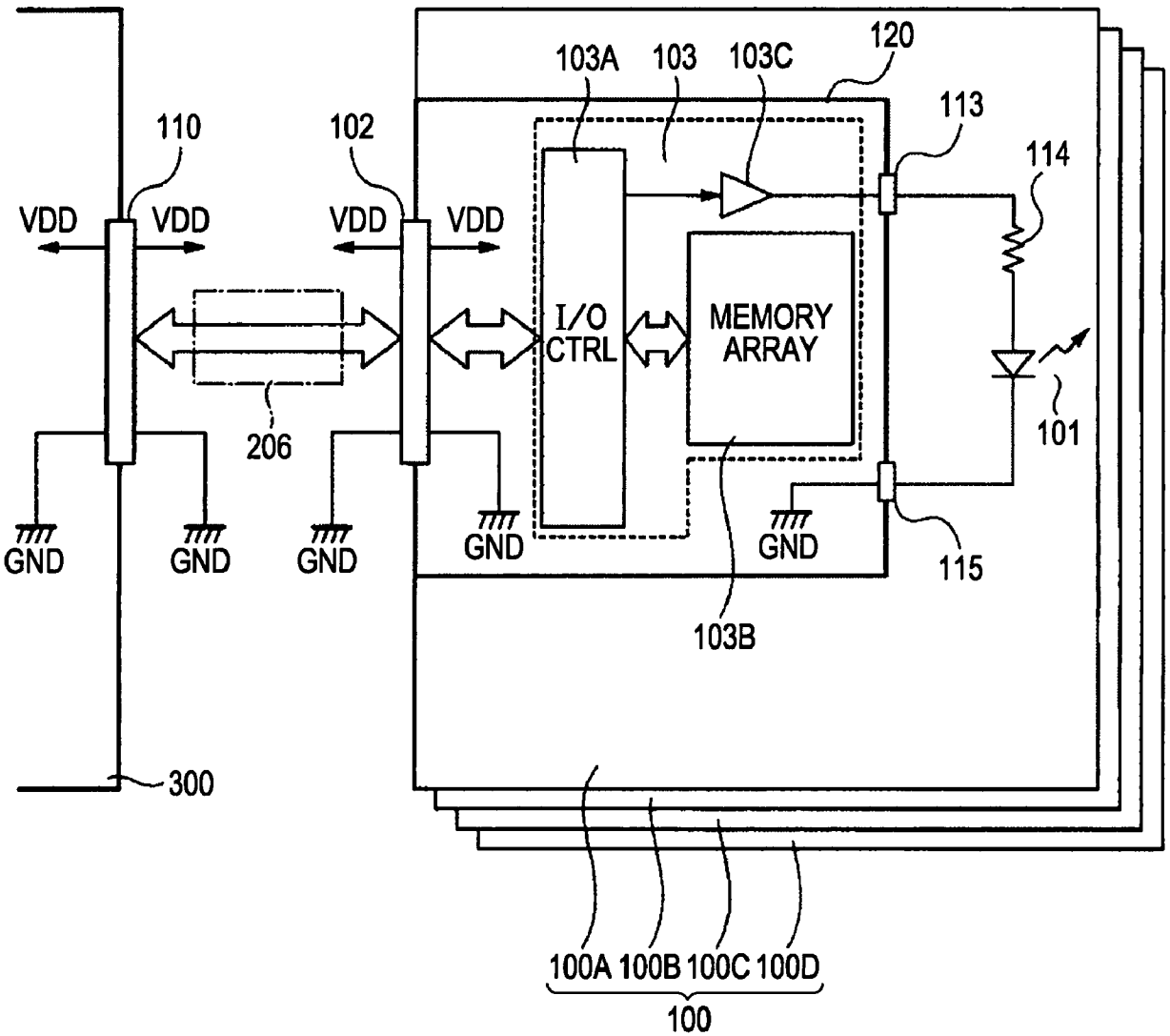
FIG. 1 is a circuit diagram illustrating an example of the structure of a circuit substrate (module) provided on an ink tank according to an embodiment of the present invention.
Figure 2:
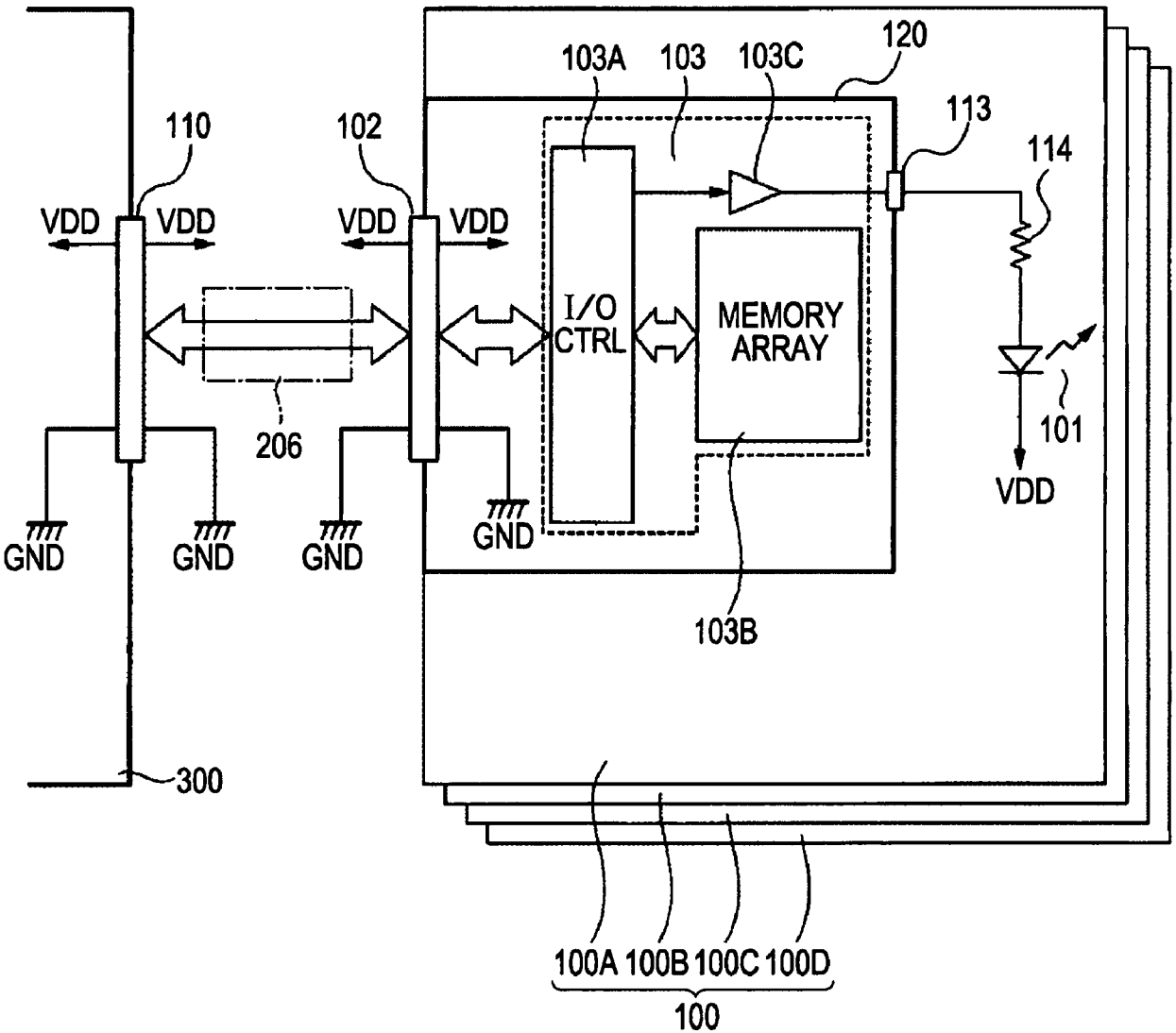
FIG. 2 is a circuit diagram illustrating another example of the structure of a circuit substrate (module) provided on the ink tank according to the embodiment of the present invention.

Structure Around Information Presenting Control Unit (FIGS. 1 and 2)

FIG. 1 is a circuit diagram illustrating an information presentation means consisting of a substrate or module (100) provided with an information presentation control unit according to the present invention. In the present embodiment, an ink tank, ink, and a light-emitting diode (LED), are explained as a cartridge, a recording material, and information-presenting means, respectively.

The control unit 103 provided on each of the substrates 100A to 100D on the ink tanks includes a memory array 103B (storage element), an LED driver 103C (driving unit), and an input/output control circuit (I/O CTRL) 103A (arbitration unit) that controls the memory array 103B and the LED driver 103C. The input/output control circuit 103A receives control data from the control circuit 300 disposed in the printer main body via the flexible cable 206. The input/output control circuit 103A controls the operation of causing the LED 101 to present information or the operation of writing/reading data to/from the memory array 103B on the basis of the received control data. Although not shown in FIG. 1 since FIG. 1 is a block diagram, the control data transmitted via the flexible cable 206 is not directly input to the substrates 100A to 100D on the ink tanks but is input via carriage substrates. In FIG. 1, the connector 110 is disposed on the printer main body for control signal transmission.

The memory array 103B is an EEPROM in the present embodiment and stores data including the amount of ink remaining in the ink tank, color information representing the color of ink contained in the ink tank, and manufacturing information including a specific number of the ink tank and a manufacturing lot number. The color information representing the ink color is written to the memory array 103B at a predetermined address when the ink tank is shipped or manufactured. The color information is used as the identification information of the ink tank, as described below with reference to FIGS. 3 and 4. Since each ink tank can be identified by the color information, data can be written to or read from the memory array 103B or the LED 101 on that ink tank can be turned on or off. The data written to or read from the memory array 103B include, for example, the amount of remaining ink.

Some conventional ink tanks are structured such that a prism is attached at the bottom to optically detect that there is only a small amount of ink when the amount of remaining ink becomes small. The present embodiment can also be applied to ink tanks having such a structure.

The control circuit 300 counts the number of times ink drops are discharged from each recording head section on the basis of the discharge data used for causing the recording head section to discharge ink. Then, the control circuit 300 calculates the amount of ink remaining in the corresponding ink tank. The information of the amount of remaining ink is written to or read from the memory array 103B corresponding to the ink tank. Thus, the memory array 103B stores the information regarding the amount of ink remaining in the corresponding ink tank. This information can be used for detecting the amount of remaining ink with higher accuracy by using an optical detection method in which the prism is used for detecting the amount of remaining ink in combination. In addition, the information can also be used for determining whether the attached ink tank is new or re-attached after being used previously.

The LED driver 103C operates so as to apply a power source voltage to the LED 101 when the signal output from the input/output control circuit 103A is ON, and thereby causes the LED 101 to emit light. Accordingly, the LED 101 is continuously turned on while the signal output from the input/output control circuit 103A is ON, and is continuously turned off while the signal output from the input/output control circuit 103A is OFF.

A limiting resistor 114 determines a current applied to the LED 101. The limiting resistor 114 may be included in a substrate 120 composed of a semiconductor substrate or be mounted on each of the substrates 100A to 100D on the ink tanks.

FIG. 2 is a circuit diagram illustrating a modification of the structure of the substrates 100A to 100D shown in FIG. 1. In FIG. 2, the structure for applying a power source voltage to the LED 101 differs from that shown in FIG. 1. In the example shown in FIG. 2, the power source voltage applied to the LED 101 is supplied from a VDD power source pattern provided in the substrate 100 on the ink tank. When the control unit 103 is formed integrally on the semiconductor substrate 120, an LED connection terminal 113 shown in FIG. 2 may be provided in place of the connection terminals 113 and 115 on the semiconductor substrate 120 shown in FIG. 1. Thus, the number of connection terminals can be reduced by one, and this largely affects the area of the semiconductor substrate 120. As a result, the cost of the semiconductor substrate 120 can be reduced.

Figure 3:
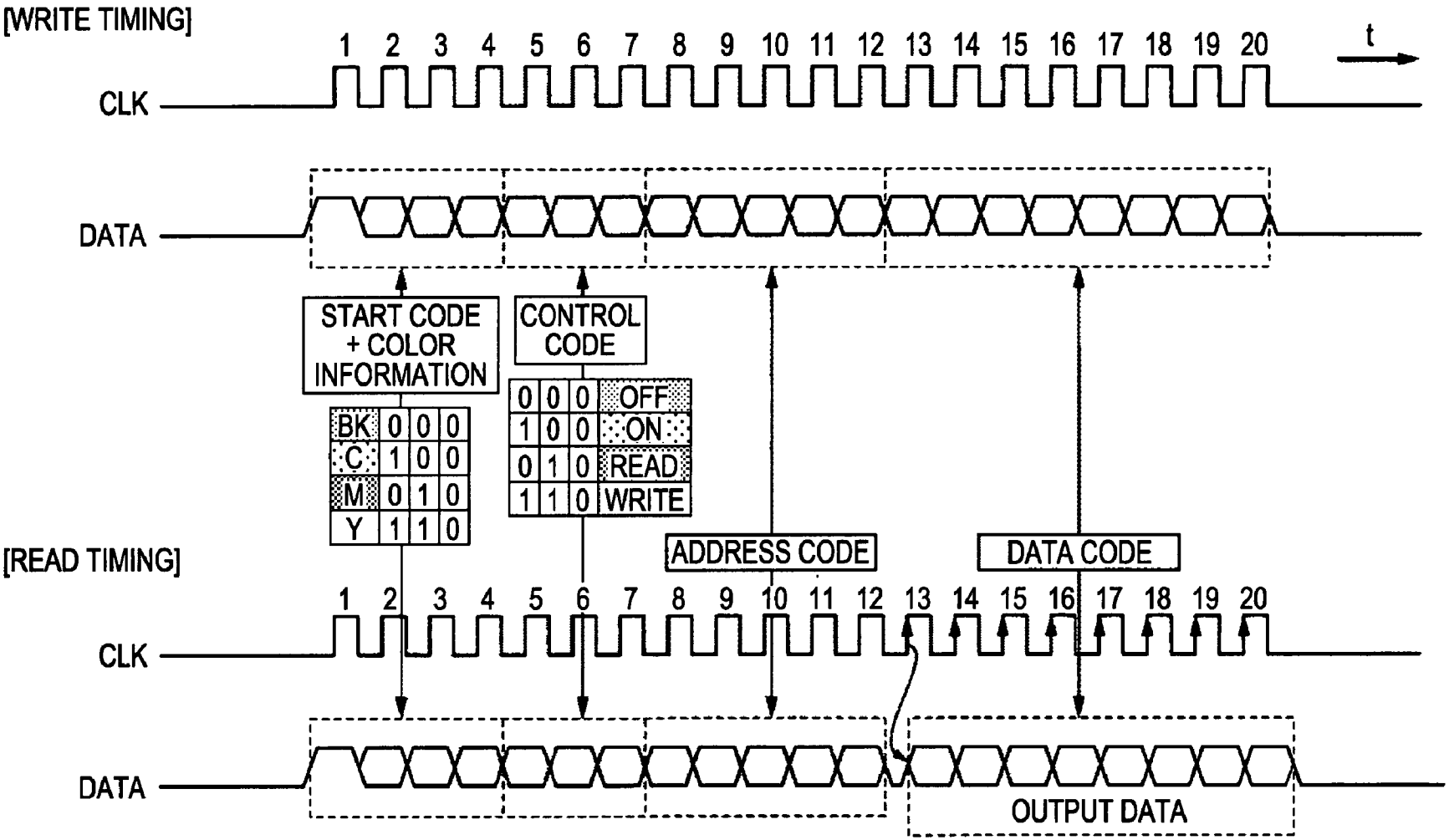
FIG. 3 is a timing chart for explaining operations of writing and reading data to/from a memory array provided on the circuit substrates shown in FIGS. 1 and 2.

Memory Control Timing Chart of Information Presentation Control Unit (FIG. 3)

FIG. 3 is a timing chart for explaining the operations of writing/reading data to/from the memory array 103B.

When data is written to the memory array 103B, data signals are transmitted in the order described below. The signals are transmitted from the control circuit 300 in the printer main body to the input/output circuit 103A in the control unit 103 of each ink tank via the signal line 'DATA'.

Data signals including 'start code+color information', 'control data', 'address code', and 'data code' are transmitted in that order in synchronization with the clock signal CLK. In 'start code+color information', 'start code' shows the start of a series of data signals, and 'color information' designates the ink tank corresponding to the series of data signals.

As shown in FIG. 3, 'color information' includes one of codes "000", "100", "010", and "110" corresponding to the colors of ink, that is, Bk (black), C (cyan), M (magenta), and Y (yellow), respectively. In each ink tank, the input/output circuit 103A compares the color information represented by the code with the color information specific to the ink tank (i.e., the color information corresponding to the color of ink contained in the ink tank) that is stored in the memory array 103B. Then, the input/output circuit 103A in each ink tank performs a process of receiving the rest of the data signals only when the received color information matches the color information of the ink tank. When the received color information does not math the color information of the ink tank, the input/output circuit 103A stops receiving the rest of the data signals. Thus, the data signals are transmitted from the printer main body to the ink tanks via the common signal line 'DATA', and the ink tank corresponding to the data signals can be determined since the color information is included in the data signals. In other words, the color information included in the data signals is compared with the color information of each ink tank to determine the ink tank corresponding to the data signals.

Accordingly, the operations of writing/reading data to/from the memory array 103B or turning on/off the LED 101 can be performed in the ink tank designated by the color information on the basis of the data signals. Therefore, the operations of writing/reading data or turning on/off the LED 101 in each ink tank can be controlled using a data signal line (for example, a single signal line) that is common to the four ink tanks. Thus, the number of signal lines required for the control can be reduced. As is clear from the following description, the structure using the common data signal line can be applied irrespective of the number of ink tanks.

As shown in FIG. 3, in the present embodiment, 'control code' includes one of codes "000", "100", "010", and "110". The codes "000" and "100" correspond to 'OFF' and 'ON', respectively, for turning off and on the LED and the codes "010" and "110" correspond to 'READ' and 'WRITE', respectively, for reading and writing data from/to the memory array. In the writing operation, the code of 'WRITE' follows the code of 'color information'. The address in the memory array at which the data is to be written is indicated by 'address code' that follows 'control code', and the contents of the data to be written is indicated by 'data code' at the end.

The contents represented by 'control code' are, of course, not limited to the above-described example. For example, control codes corresponding to a verify command, a continuous reading command, etc., may also be included.

In the case in which data is read out from the memory array 103B, the structure of the data signals is similar to the above-described case in which the data is written. More specifically, similar to the case in which the data is written, 'start code+color information' is received by the input/output circuits 103A of all of the ink tanks and the following data signals are received only by the input/output circuit 103A of the ink tank corresponding to 'color information'. In the data reading operation, the data read out from the memory array 103B is output in synchronization with the rising edge of the first clock after the address in the memory array 103B is designated by the address code (i.e., the $13^{th}$ clock in FIG. 3). As described above, even though the data signal terminals of a plurality of ink tanks are connected to the common data signal line, the input/output circuit 103A in each ink tank performs arbitration so that the data read out from the memory array 103B is not transmitted at the same time as other input signals.

Figure 4:
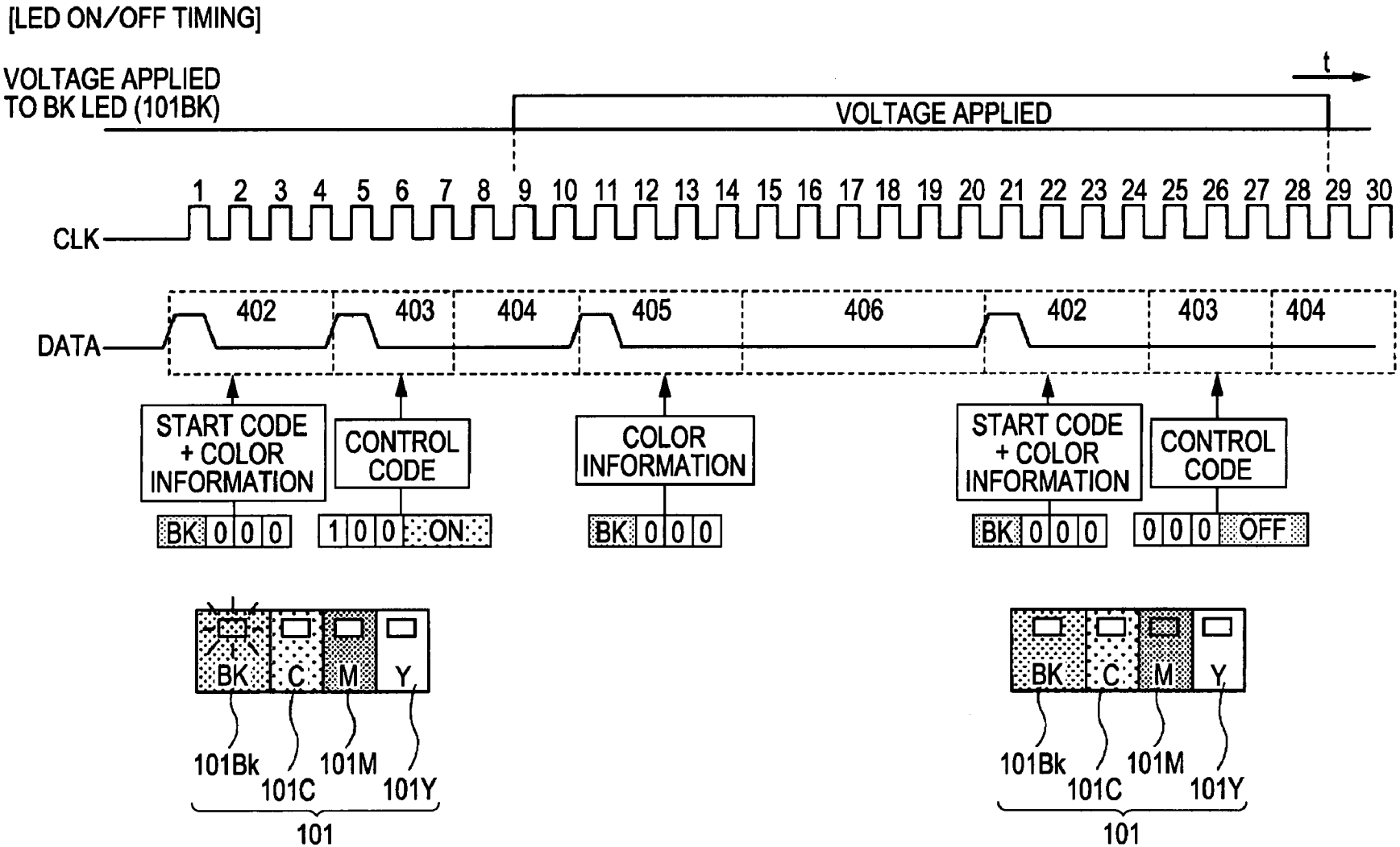
FIG. 4 is a timing chart for explaining an operation of turning on and off LEDs provided on the circuit substrates shown in FIGS. 1 and 2.
Figure 5:
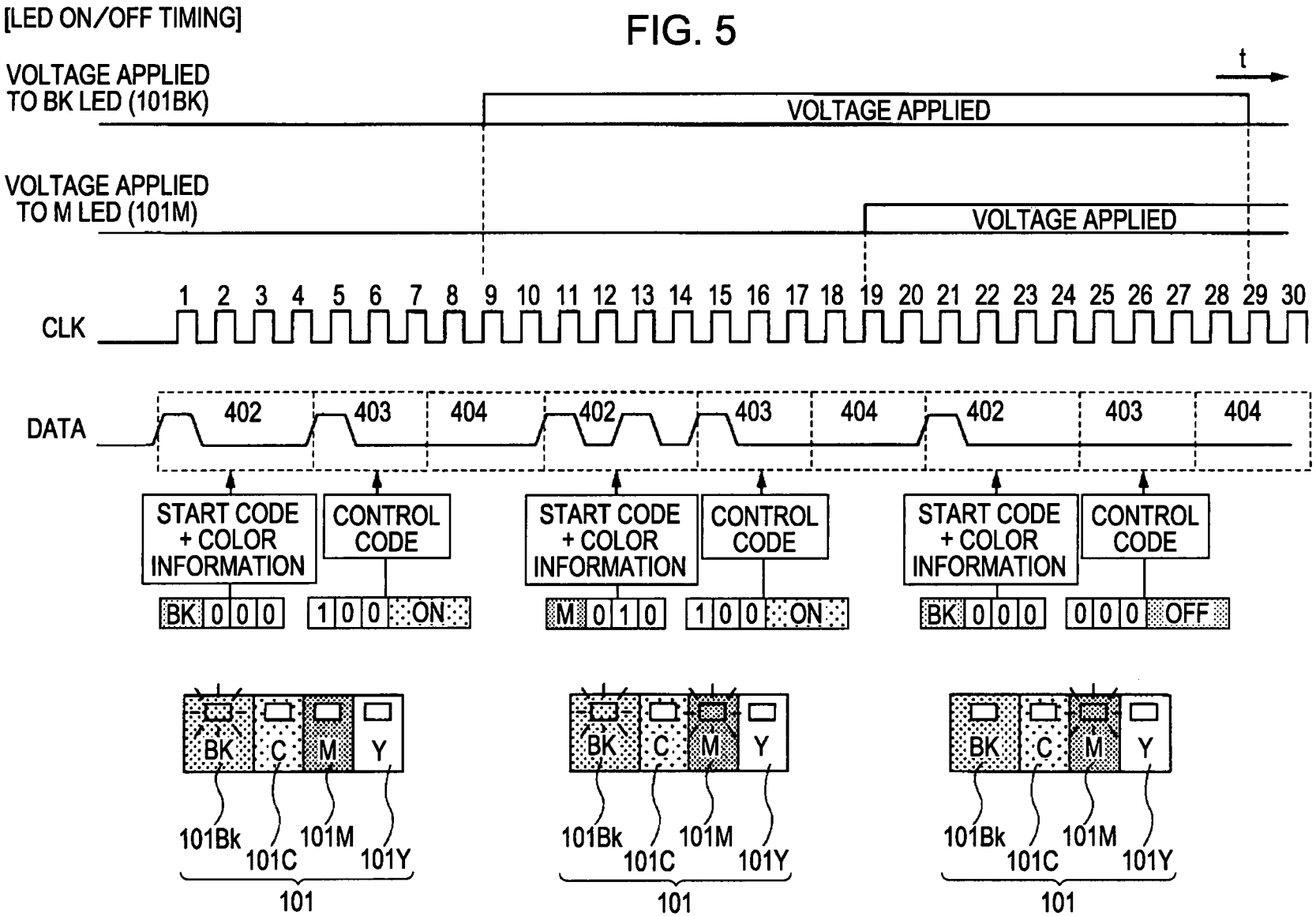
FIG. 5 is a timing chart for explaining another operation of turning on/off the LEDs provided on the circuit substrates shown in FIGS. 1 and 2.

LED Control Timing Chart of Information Presentation Control Unit (FIGS. 4 and 5)

FIG. 4 is a timing chart for explaining the operation of turning on/off the LEDs 101.

As shown in FIG. 4, in the operation of turning on/off the LED 101, first, a data signal 402 of 'start code +color information' is transmitted from the printer main body to the input/output circuit 103A via the signal line DATA. As described above, one of the ink tanks is designated by 'color information', and only the LED 101 on the designated ink tank is turned on or off on the basis of a data signal 403 of 'control code' that is subsequently transmitted.

As described above with reference to FIG. 3, the data signal 403 of 'control code' for turning on/off the LED 101 includes one of codes corresponding to 'ON' and 'OFF'. The LED 101 is turned on when the code for 'ON' is received and is turned off when the code for 'OFF' is received. Referring to FIG. 4, the LEDs 101 (101Bk, 101C, 101M, and 101Y) are provided on the ink tanks containing black (Bk) ink, cyan (C) ink, magenta (M) ink, and yellow (Y) ink, respectively, and are turned on or off on the basis of the data signals 402 and 403. The LEDs 101Bk, 101C, 101M, and 101Y on the left in FIG.

4 are in the state in which only the LED 101Bk is turned on, and the LEDs 101Bk, 101C, 101M, and 101Y on the right in FIG. 4 are in the state in which the LED 101Bk is turned off afterwards.

When 'control code' is 'ON', the input/output circuit 103A outputs the ON signal to the LED driver 103C, as described above with reference to FIG. 2. Therefore, noise is easily generated at that time. If the noise enters the signal line while the data signal 402 of 'start code+color information' or the data signal 403 of 'control code' is being transmitted, there is a risk that '0' will change to '1' or '1' will change to '0'. If even only one of the bits in the data signals 402 and 403 is changed, the commands will be change and unexpected operations will be performed as a result. This also occurs when the LED 101 is turned off in response to the 'OFF' code.

In light of the above-described situation, in the present embodiment, an inactive period 404 is provided after the data signal 403 of 'control code'. The time at which the input/output circuit 103A outputs the ON signal to the LED driver 103C is set within the inactive period 404. More specifically, when 'control code' is 'ON', the ON signal is output to the LED driver 103C in the inactive period 404, and the output state is maintained after that period. When 'control code' is 'OFF', the input/output circuit 103A outputs the OFF signal to the LED driver 103C in the inactive period 404, and maintains the output state after that period.

As shown in FIG. 4, after the operation of turning on/off the LED 101 is performed in the inactive period 404, the ink tank that has performed the operation returns a data signal 405 of 'color information' to the printer main body. The data signal 405 shown in FIG. 4 is returned from the ink tank containing black (Bk) ink and having the LED 101Bk after the LED 101Bk is turned on. More specifically, the data signal 405 includes the code "000" corresponding to black (Bk) ink as 'color information'.

If, for example, the data signals 402 and 403 of 'start code+color information' and 'control code' are changed due to noise generated by a cause other than the transmission of ON signal to the LED driver 103C, there is a risk that the operation of turning on/off the LED 101 cannot be normally performed. In such a case, the data signal 405 of 'color information' is not transmitted from the input/output circuit 103A to the printer main body. Therefore, the printer main body can determine whether or not the operation of turning on/off the LED 101 is normally performed. When the data signal 405 of 'color information' is not transmitted to the printer main body, the printer main body transmits the data signals 402 and 403 of 'start code+color information' and 'control code' again to recover the operation.

In the example shown in FIG. 4, first, the ink tank containing black (Bk) ink is designated by the data signal 402 at the left end in the figure. Then, the LED 101Bk on that ink tank is turned on in response to the following data signal 403. In practice, the LED 101Bk is turned on when the LED driver 103C applies a predetermined voltage to the LED 101Bk at the $9^{th}$ clock in the inactive period 404. Then, the data signal 405 of 'color information' is transmitted from the input/output circuit 103A in the ink tank containing black (Bk) ink to the printer main body. Accordingly, the printer main body recognizes that the operation of turning on the LED 101Bk has been performed by receiving the data signal 405. Then, the ink tank containing black (Bk) ink is designated by the subsequent data signal 402, and the LED 101Bk on that ink tank is turned off in response to the following data signal 403. In practice, the LED 101Bk is turned off when the LED driver 103C stops applying the voltage to the LED 101Bk at the $29^{th}$ clock in the inactive period 404.

Thus, the operation of turning on/off the LED 101 is performed in the inactive period 404 in which the data signals are not transmitted. Therefore, even when noise is generated when the drive voltage is applied to the LED 101 or switched off, the noise is prevented from adversely affecting the data signals.

FIG. 5 is a timing chart for explaining an operation different from that shown in FIG. 4 (operation of turning on/off the LED 101). In this example, the process of returning the data signal 405 of 'color information' described with reference to FIG. 4 is omitted.

In the example shown in FIG. 5, first, the ink tank containing black (Bk) ink is designated by the data signal 402 at the left end in the figure. Then, the LED 101Bk on that ink tank is turned on in response to the following data signal 403. In practice, the LED 101Bk is turned on when the LED driver 103C applies a predetermined voltage to the LED 101Bk at the $9^{th}$ clock in the inactive period 404. Then, the subsequent data signal 402 of 'color information' designates the ink tank containing magenta (M) ink, and the data signal 403 of 'control code' indicates the process of turning on the LED. Accordingly, the LED 101M is turned on while the LED 101Bk is continuously turned on. In practice, the LED 101M is turned on when the LED driver 103C applies a predetermined voltage to the LED 101M at the $19^{th}$ clock in the inactive period 404. Then, the subsequent data signal 402 of 'color information' designates the ink tank containing black (Bk) ink, and the data signal 403 of 'control code' indicates the operation of turning off the LED. Accordingly, the LED 101Bk is turned off while the LED 101M is continuously turned on. In practice, the LED 101Bk is turned off when the LED driver 103C stops applying the voltage to the LED 101Bk at the $29^{th}$ clock in the inactive period 404.

Thus, in this example, the step of returning the data signal 405 of 'color information' described with reference to FIG. 4 is omitted. In other words, the input/output circuit 103A of the ink tank does not return the data signal 405 of 'color information' to the printer main body. Accordingly, the number of clocks required in the operation can be reduced. This example is effective when the reduction in the on/off period of the LEDs is prioritized over the operation reliability.

As is clear from the above, the LED on each ink tank can be caused to blink by transmitting the data signals including 'control code' that represents a command for turning on/off the LED from the control circuit 300 to the ink tank. In such a case, the blinking period of the LED can be controlled in accordance with the period at which the data signals are transmitted.

Control Procedure (FIGS. 6 to 9)

Figure 6:
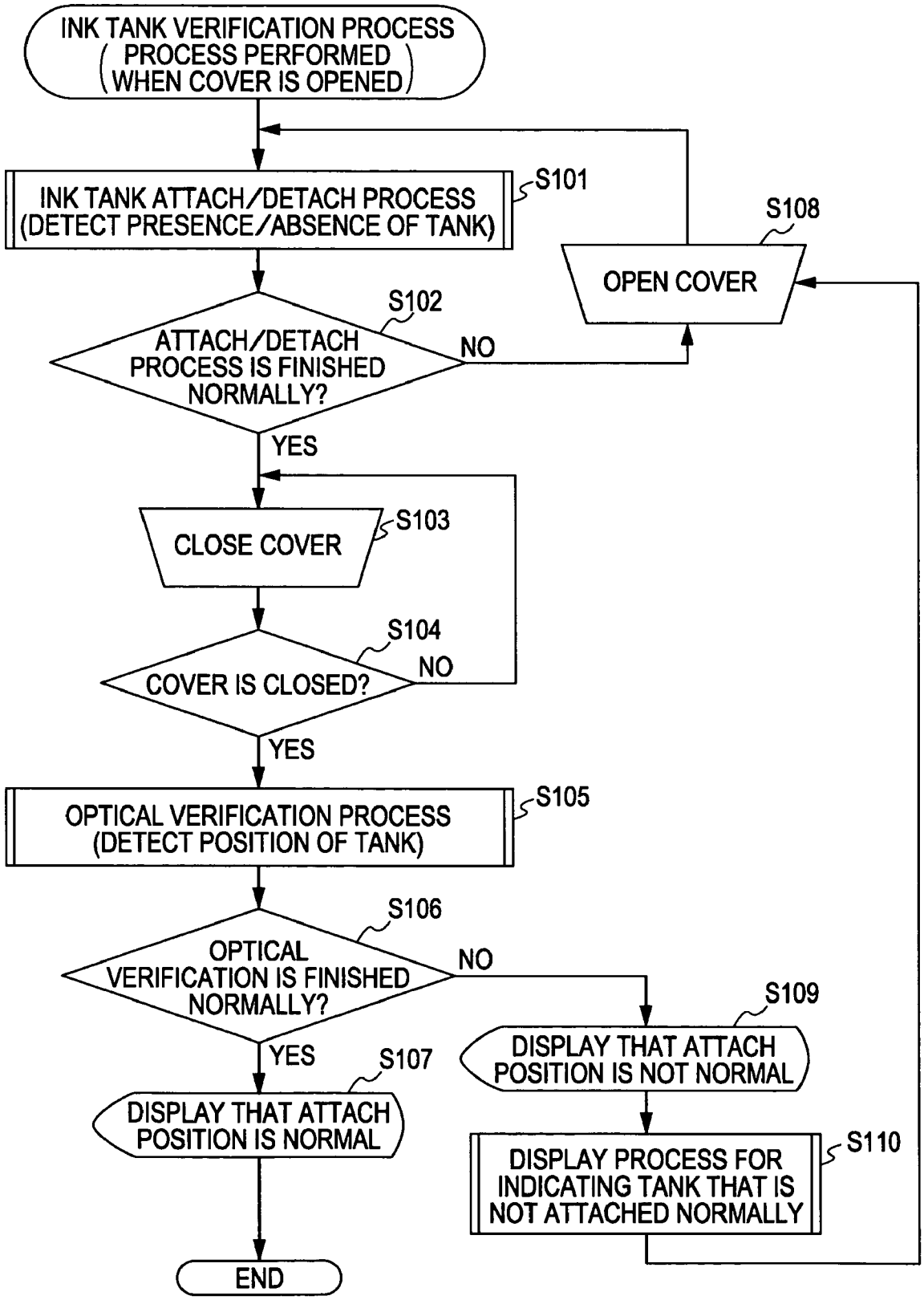
FIG. 6 is a flowchart illustrating an ink-tank verification process according to the embodiment of the present invention.

FIG. 6 is a flowchart illustrating a control procedure executed when the ink tanks are attached or detached, in particular, a process performed by the control circuit 300 disposed in the printer main body to turn on or off the LEDs 101 (101Bk, 101C, 101M, and 101Y) on the ink tanks.

Referring to FIG. 6, an ink-tank verification process is performed when the user opens the main cover 201 (see FIGS. 10 and 11) of the printer, and is started when a sensor detects that the main cover 201 is opened. When this process is started, first, an ink-tank attach/detach process is performed in step S101.

Figure 7:
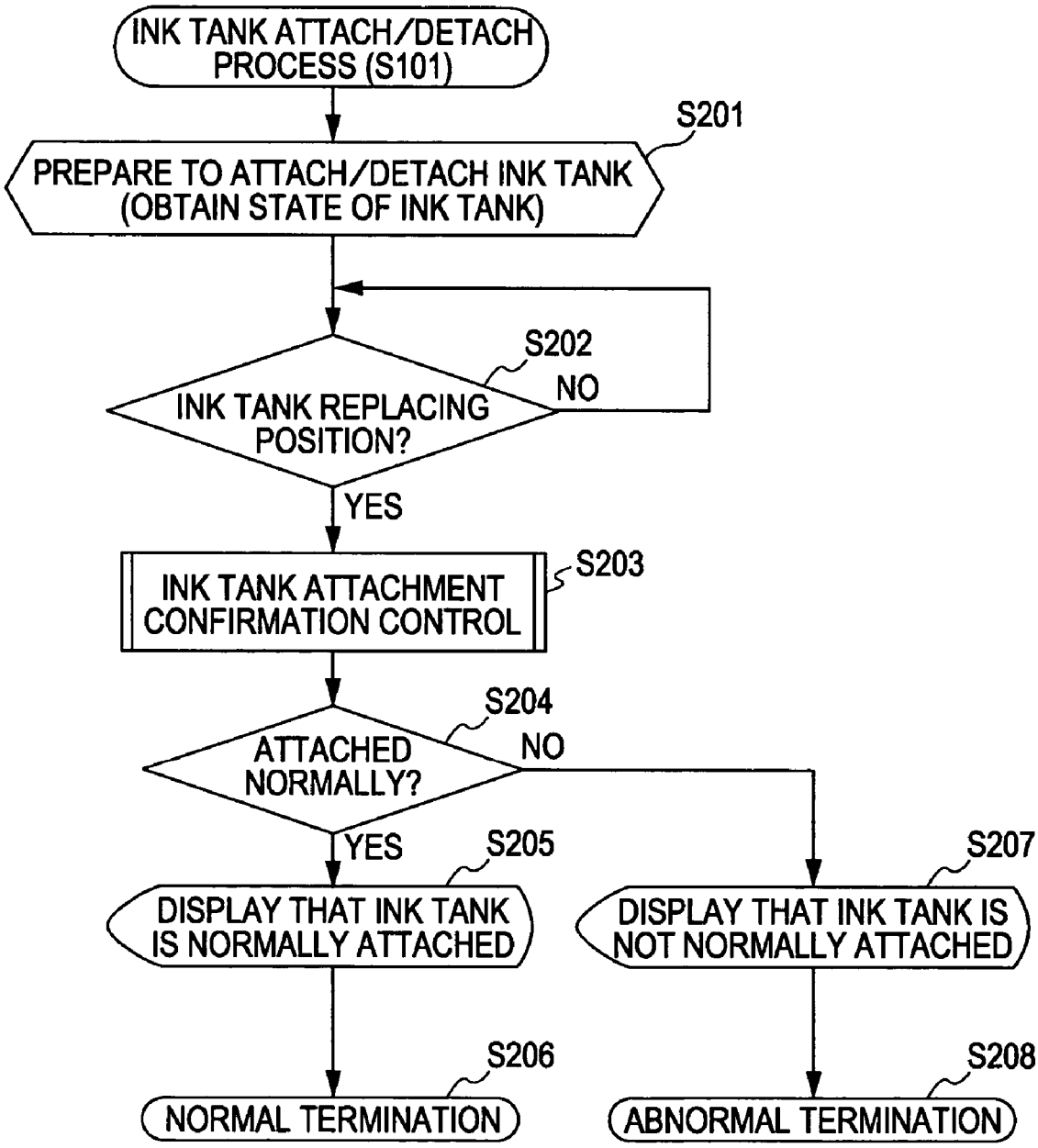
FIG. 7 is a flowchart illustrating an ink-tank attach/detach process performed in the process shown in FIG. 6.

FIG. 7 is a flowchart illustrating the ink-tank attach/detach process. In the attach/detach process shown in FIG. 7, first, the carriage 205 is moved in the main-scanning direction and information representing the state of the ink tanks mounted on the carriage 205 is obtained from the ink tanks in step S201. This information includes the amount of remaining ink and is read out from the memory arrays 103B together with the specific numbers of the ink tanks. Then, in step S202, it is determined whether or not the carriage 205 has reached the ink-tank replacing position described above with reference to FIG. 11.

If it is determined that the carriage 205 has reached the ink-tank replacing position, ink-tank attachment confirmation control is performed in step S203.

Figure 8:
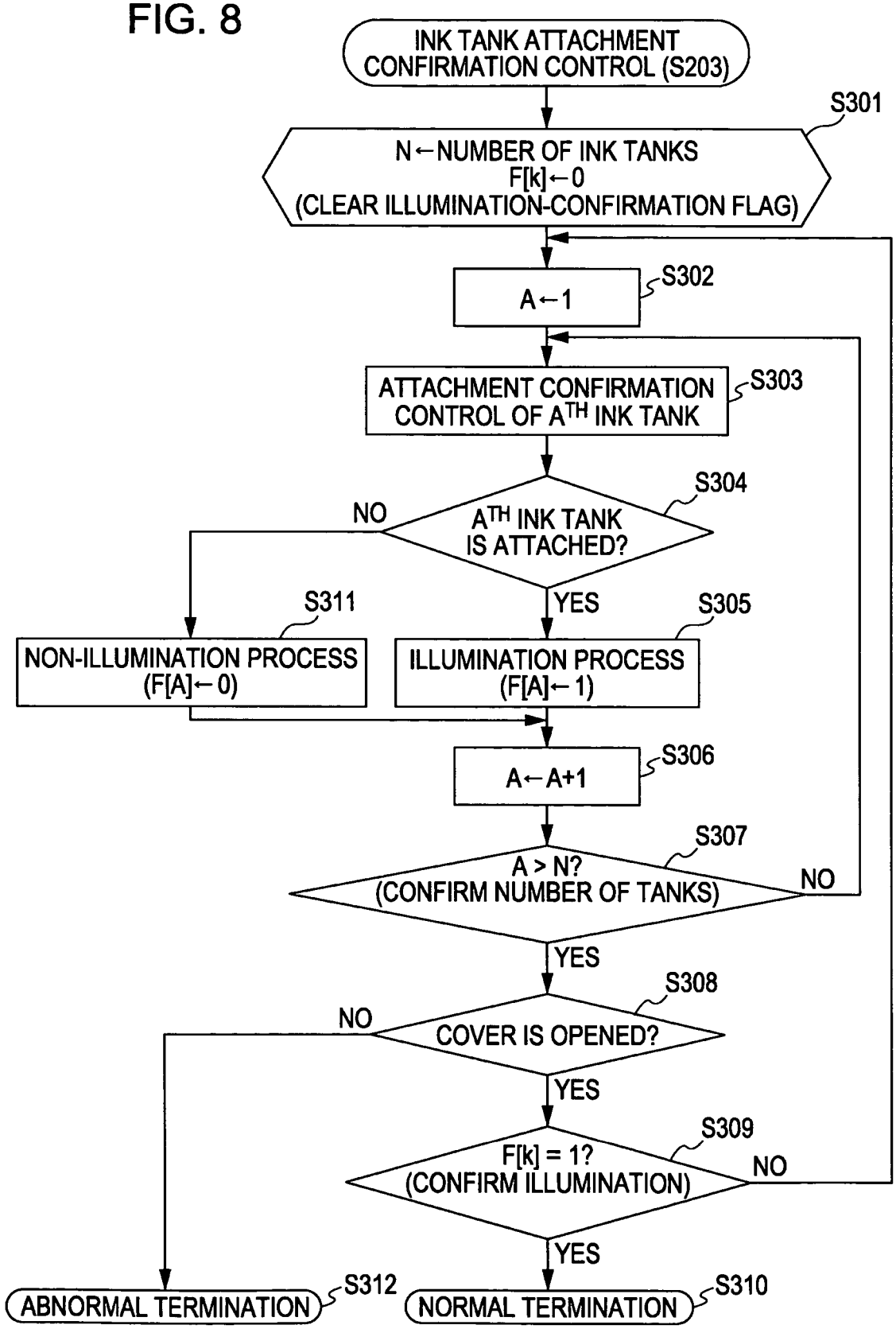
FIG. 8 is a flowchart illustrating an ink-tank attachment confirmation control process performed in the process shown in FIG. 7.

FIG. 8 is a flowchart illustrating the attachment confirmation control performed in step S203. In the attachment confirmation control, first, in step S301, a parameter N indicating the number of ink tanks mounted on the carriage 205 is set and flags F(k) for confirming whether the LEDs are turned on or off are initialized in accordance with the number of ink tanks. In the present embodiment, N is set to 4 for the ink tanks 1B, 1C, 1M, and 1Y. Accordingly, four flags F(k), that is, flags F(1), F(2), F(3), and F(4) are prepared for the ink tanks 1B, 1C, 1M, and 1Y, respectively, and are initialized to "0".

Next, in step S302, a parameter A for setting the order in which whether or not the ink tanks are mounted at proper positions is checked is set to 1. Then, in step S303, attachment confirmation control for the $A^{th}$ ($1^{st}$) ink tank, that is, the ink tank 1B corresponding to the flag F(1) is performed. As described above, when the user attaches the ink tank 1B to the recording head 105, the contact 152 (see FIG. 15) on the corresponding tank holder section and the contact 102 (see FIG. 15) on the ink tank come into contact with each other. In the attachment confirmation control performed in step S303, as described above, the control circuit 300 in the printer main body identifies the $1^{st}$ ink tank 1B by the color information and reads out the color information stored in the memory array 103B of the ink tank 1B.

Then, in step S304, it is determined whether or not the ink tank 1B is attached. More specifically, it is determined that the ink tank 1B is attached when the color information can be read out from the ink tank 1B and the obtained color information is different from any of the color information that has been previously read out. In other cases, it is determined that the ink tank 1B is not attached. If it is determined that the $1^{st}$ ink tank, that is, the ink tank 1B, is attached, the corresponding flag F(1) is set to "1" in step S305. Then, the control code is set to 'ON' as described above, so that the LED 101Bk on the ink tank 1B is turned on in response to the control code and the color information corresponding to the ink tank 1B. If it is determined that the ink tank 1B is not attached, the corresponding flag F(1) is set to "0" in step S311.

Next, the parameter A is incremented by one in step S306. Then, in step S307, it is determined whether or not the incremented parameter A is larger than N (4 in this example) set in step S301. If the parameter A is equal to or less than N, step S303 and the following steps are repeated. Accordingly, the attachment confirmation control is performed for the $2^{nd}$, $3^{rd}$, and $4^{th}$ ink tanks, that is, the ink tanks 1C, 1M, and 1Y corresponding to the flag F(2), F(3), and F(4), respectively, in that order.

In the attachment confirmation control, color information that has previously been read out is, of course, not used as the color information for identifying the ink tanks. In this control, when the color information is read out from the ink tanks, it is determined whether or not the obtained color information is different from any of the color information read out since the start of the process.

When the parameter A reaches N (4 in this example), it is determined that the attachment confirmation control is finished for all of the ink tanks. Then, in step S308, it is determined whether or not the main cover 201 is opened on the basis the output from the above-mentioned sensor. If the main cover 201 is closed, there is a possibility that the user has closed the main cover 201 while one or more of the ink tanks are not attached or attached improperly. In this case, an abnormal status is fed back to the process routine shown in FIG. 7 in step S312 and this process is finished.

If it is determined that the main cover 201 is opened in step S308, it is determined whether or not all of the four flags F(1), F(2), F(3), and F(4) are set to "1". In other words, it is determined whether or not all of the ink tanks are attached and their LEDs 101 are turned on. If it is determined that the LEDs 101 on one or more of the ink tanks are not turned on, step S302 and the following steps are repeated. Accordingly, the user attaches or reattaches the ink tanks having the LEDs 101 that are not turned on, and the above-described steps are repeated until the LEDs 101 on those ink tanks are turned on. If it is determined that the LEDs 101 on one or more of the ink tanks are not turned on in step S309, the LEDs 101 that are already turned on can be caused to blink so that the user can easily recognize that there are ink tanks that are not attached or attached improperly (i.e., there are ink tanks whose contacts are not in contact with the contacts on the tank holder sections).

If it is determined that LEDs 101 on all of the ink tanks are turned on, the process is normally terminated in step S310 and returns to the process routine shown in FIG. 7.

Referring to FIG. 7 again, the ink-tank attachment confirmation control shown in FIG. 8 is performed as described above in step S203. Then, in step S204, it is determined whether or not the control has been normally terminated, that is, whether or not all of the ink tanks are attached. If it is determined that all of the ink tanks are attached, the display included in the operating unit 213 (see FIGS. 10 and 11) is illuminated in, for example, green. Then, the process is terminated normally in step S206 and returns to the process routine shown in FIG. 6. If it is determined that not all of the ink tanks are attached, the display included in the operating unit 213 is illuminated in, for example, orange, in step S207. Then, the process is terminated abnormally in step S208 and returns to the process routine shown in FIG. 6. If a host device like a personal computer (PC) for controlling the printer is provided, the amounts of remaining ink can be displayed on a monitor of the hose device at the same time.

In FIG. 6, the ink-tank attach/detach process shown in FIG. 7 is performed as described above in step S101. Then, in step S102, it is determined whether or not the attach/detach process is finished normally. If it is determined that the attach/detach process is finished abnormally, the process waits until the user opens the main cover 201 in step S108. When the cover 201 is opened, step S101 is performed again and the process shown in FIG. 7 is repeated.

If it is determined that the attach/detach process is finished normally in step S102, the process waits until the user closes the main cover 201 in step S103. Then, it is determined whether or not the cover 201 is closed in step S104. If the main cover 201 is closed, an optical verification process is performed in step S105. When it is detected that the main cover 201 is closed, the carriage 205 is moved to a position for the optical verification process and the LEDs 101 illuminating on the ink tanks are turned off.

The optical verification process is performed for determining whether or not the normally attached ink tanks are placed at proper attachment positions. The shape of each tank is associated with the shape of the attachment portion at which the tank is to be attached. Although structures are know in which designated attachment positions are set for the ink tanks containing different kinds of ink so that each ink tank is prevented from being attached at the attachment positions for other ink tanks, such a structure is not used in the present embodiment. Therefore, there is a possibility that the ink tanks will not be attached at the attachment positions for the respective ink tanks and be attached at the attachment positions for other ink tanks by mistake.

Accordingly, in the optical verification process, when the ink tanks are attached at wrong positions, the user is informed of the situation. Therefore, it is not necessary to prepare ink tanks having different shapes depending on the colors of ink contained therein. Accordingly, the manufacturing efficiency of the ink tanks can be increased and the costs thereof can be reduced.

In the optical verification process, the carriage 205 is moved in the main-scanning direction and the LED 101Y on the tank 1Y is caused to emit light at the time when the position of the tank holder section in which the tank 1Y is to be attached faces the first light-receiving unit 210 (see FIG. 12). If the tank 1Y is properly attached to the tank holder section in which the tank 1Y is to be attached, the first light-receiving unit 210 receives the light emitted by the LED 101Y. Accordingly, the control circuit 300 determines that the tank 1Y is attached at the proper position. If the first light-receiving unit 210 cannot receive the light emitted from the LED 101Y, it is determined that the tank 1Y is not attached at the proper position.

Similarly, it is determined whether or not the other ink tanks 1B, 1M, and 1C are attached at the proper positions.

After the optical verification process, it is determined whether or not the process is finished normally, that is, whether or not all of the ink tanks are attached at proper positions in step S106. If it is determined that the process is normally finished and all of the ink tanks are attached at proper positions, the display in the operating unit 213 is illuminated in, for example, green in step S107 and the process is finished. If it is determined that the optical verification process is abnormally finished and there are ink tanks that are not attached at proper positions, the display included in the operating unit 213 is illuminated in, for example, orange in step S109. Then, the LEDs 101 provided on the ink tanks that are determined to be attached at the wrong attachment positions in step S105, that is, the LEDs 101 provided on the ink tanks that are not attached at the proper attachment positions, are caused to blink or turned on in step S110. Accordingly, when the user opens the main cover 201 in step S108, the user can recognize the ink tanks that are not attached at the proper positions and be prompted to reattach the ink tanks at the proper positions.

Figure 9:
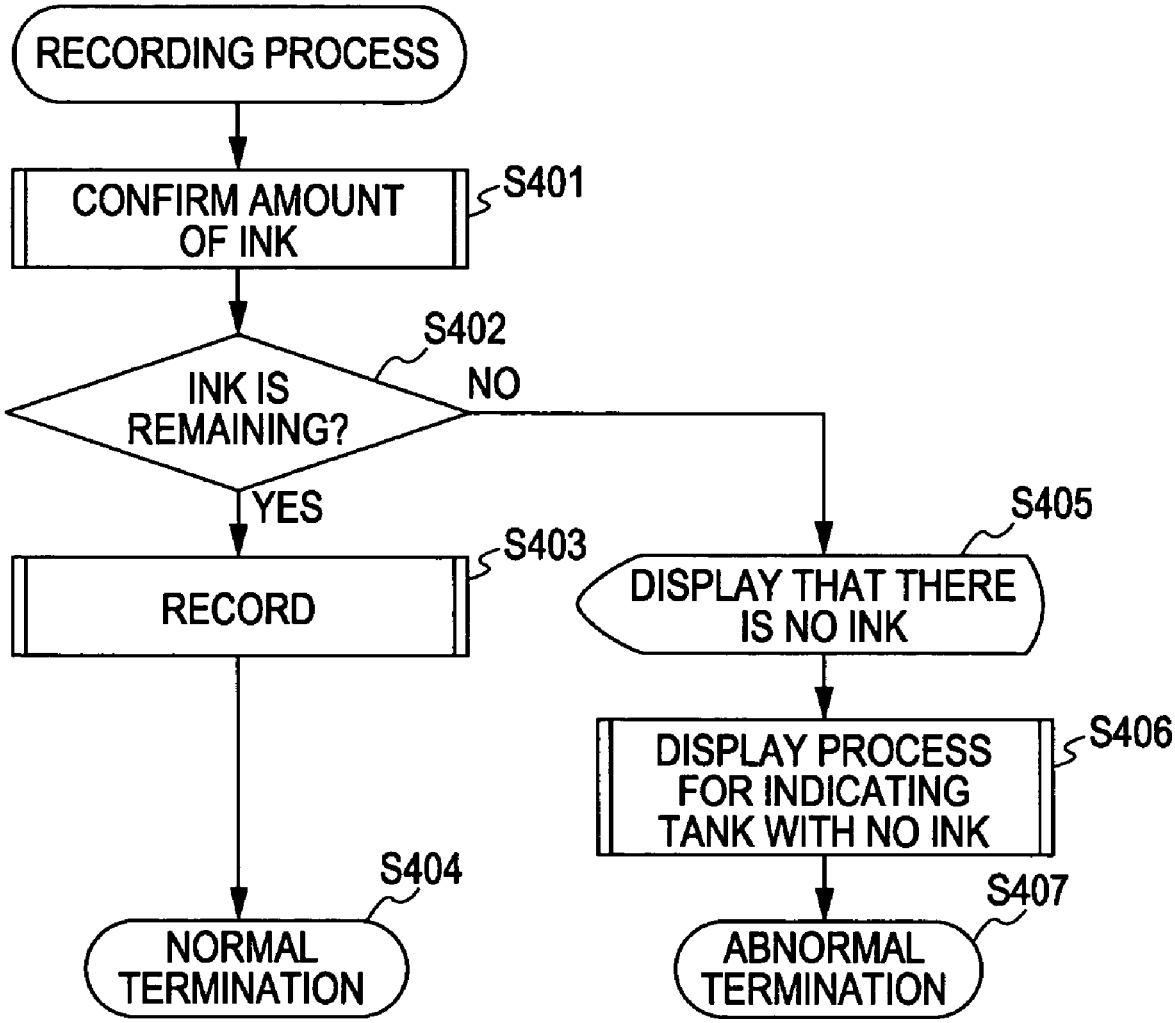
FIG. 9 is a flowchart illustrating a recording process according to the embodiment of the present invention.

FIG. 9 is a flowchart illustrating a recording process according to the present embodiment. In this process, first, the amount of remaining ink is confirmed in step S401. The confirmation process is performed by determining the amount of recording (which corresponds to the amount of ink consumed) required for a job to be performed on the basis of record data and comparing the determined amount of recording with the amount of ink remaining in each tank. Thus, it is determined whether or not the amount of ink enough to perform the job is remaining in each ink tank. As described above, the amount of ink remaining in each ink tank may be calculated by the control circuit 300 on the basis of the number of times the ink drops are discharged, or using an alternative method.

In step S402, it is determined whether or not an amount of ink required for recording is contained in each ink tank on the basis of the result of the confirmation process. If it is determined that there is a sufficient amount of ink, the recording operation is performed in step S403. Then, the display in the operating unit 213 is illuminated in green in step S404, and the process is terminated normally. If is determined that the amount of ink is not sufficient in step S402, the display in the operating unit 213 is illuminated in orange in step S405. Then, in step S406, the LED 101 on the ink tank in which sufficient amount of ink is not contained is caused to blink or is turned on, and the process is terminated abnormally.

As described above with reference to FIGS. 6 to 9, the control circuit 300 is capable of controlling the illumination of the LED on each ink tank. More specifically, each of the ink tanks can be designated and the LED on the designated ink tank can be turned on/off or caused to blink on the basis of the signals including 'color information' and 'control code'. In addition, the time at which the LED is turned on or off is set in the inactive period, as described above. Thus, since the operation of turning on or off the LED is performed in the inactive period in which the data signals are not transmitted, even if noise is generated by the operation, the noise can be prevented from adversely affecting the data signals.

Other Embodiments

The present invention may be applied to an ink tank (liquid container) module that serves as a functional element for controlling an LED (light-emitting unit) on the basis of a signal input from a printer (recording apparatus). The module may include, for example, the LED 101 and the semiconductor substrate 120. In addition, the contact 102 may also be included. The module is not particularly limited as long as the module can be installed in or on the ink tank and the driving of the LED 101 by the LED driver (driving unit) 103C can be controlled on the basis of the signal input from the printer in a time period different from that in which the LED drive voltage is applied.

In addition, according to the present invention, the functional element for controlling the LED may be provided directly on (i.e. integral with) the ink tank.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the priority of Japanese Application No. 2005-183981 filed Jun. 23, 2005, which is hereby incorporated by reference herein in its entirety.

What is claimed is:

1. A signaling module mountable on a liquid container for supplying liquid to a recording/printing apparatus, the signaling module comprising:

a signal-connecting portion capable of receiving an input signal from the recording/printing apparatus;

a light-emitting unit capable of emitting light;

a light-emission driving unit that drives the light-emitting unit;

a control circuit that controls the driving of the light-emitting unit by the light-emission driving unit on the basis of the input signal transmitted from the signal-connecting portion;

an information storage portion that stores information regarding the liquid container;

wherein the control circuit arranges for the driving of the light-emitting unit by the light-emission driving unit to occur in a period different from the period in which the input signal is transmitted from the signal-connecting portion, wherein the control circuit performs at least one of a driving process or an information process on the basis of the input signal transmitted from the signal-connecting portion, the control circuit controlling the driving of the light-emitting unit by the light-emission driving unit in the driving process and controlling at least one of an operation of writing information to the information storage portion and an operation of reading information from the information storage portion in the information process, and wherein the control circuit performs the driving process in a signal input/output inactive period provided between periods in which signals are input and output from the signal-connecting portion.

* * * * *